US006935424B2

(12) United States Patent
Lehman et al.

(10) Patent No.: US 6,935,424 B2
(45) Date of Patent: Aug. 30, 2005

(54) MITIGATING RISK BY USING FRACTURE MAPPING TO ALTER FORMATION FRACTURING PROCESS

(75) Inventors: Lyle V. Lehman, Katy, TX (US); Christopher A. Wright, San Francisco, CA (US)

(73) Assignees: Halliburton Energy Services, Inc., Duncan, OK (US); Pinnacle Technologies, Inc., San Francisco, CA (US)

( * ) Notice: Subject to any disclaimer, the term of this patent is extended or adjusted under 35 U.S.C. 154(b) by 178 days.

(21) Appl. No.: 10/260,651

(22) Filed: Sep. 30, 2002

(65) Prior Publication Data

US 2004/0206495 A1 Oct. 21, 2004

(51) Int. Cl.[7] ..... E21B 43/26; E21B 47/00
(52) U.S. Cl. ..... 166/250.1; 166/308.1
(58) Field of Search ..... 166/308, 250.1

(56) References Cited

U.S. PATENT DOCUMENTS

| | | | | | |
|---|---|---|---|---|---|
| 4,157,116 | A | * | 6/1979 | Coulter | 166/280.1 |
| 4,271,696 | A | | 6/1981 | Wood | 73/37 |
| 4,280,200 | A | | 7/1981 | Silverman | 367/37 |
| 4,353,244 | A | | 10/1982 | Wood | 73/37 |
| 4,446,433 | A | | 5/1984 | Shuck | 324/338 |
| 4,744,245 | A | | 5/1988 | White | 73/151 |
| 4,802,144 | A | | 1/1989 | Holzhausen et al. | 367/35 |
| 4,831,600 | A | | 5/1989 | Hornby et al. | 367/31 |
| 4,832,121 | A | * | 5/1989 | Anderson | 166/250.09 |
| 4,870,627 | A | * | 9/1989 | Hsu et al. | 367/69 |
| 5,002,431 | A | | 3/1991 | Heymans et al. | 405/128 |
| 5,010,527 | A | | 4/1991 | Mahrer | 367/86 |
| 5,322,126 | A | * | 6/1994 | Scott, III | 166/308.1 |
| 5,377,104 | A | | 12/1994 | Sorrells et al. | 364/421 |
| 5,413,179 | A | * | 5/1995 | Scott, III | 166/308.1 |
| 5,417,013 | A | | 5/1995 | Tillmann | 73/37 |
| 5,441,110 | A | * | 8/1995 | Scott, III | 166/308.1 |
| 5,442,173 | A | * | 8/1995 | Wraight | 250/260 |
| 5,503,225 | A | * | 4/1996 | Withers | 166/250.1 |
| 5,524,709 | A | * | 6/1996 | Withers | 166/250.1 |
| 5,574,218 | A | | 11/1996 | Withers | 73/152.02 |

(Continued)

FOREIGN PATENT DOCUMENTS

| | | | |
|---|---|---|---|
| WO | WO 01/81724 A1 | 11/2001 | E21B/43/26 |

OTHER PUBLICATIONS

S. C. Tsai, D. Botts, and J. Plouff, "Effects of particle properties on the rheology of concentrated noncolloidal suspensions," The Society of Rheology, Inc., J. Rheol. 36(7), pp. 1291–1305 (Oct. 1992).

(Continued)

*Primary Examiner*—Hoang Dang
(74) *Attorney, Agent, or Firm*—Robert A. Kent; E. Harry Gilbert, III

(57) ABSTRACT

A formation fracturing method with which to mitigate risk to hydrocarbon productivity includes pumping fracturing fluid, during at least part of a fracturing job time period, into a well to fracture a formation; generating signals, within the fracturing job time period, in response to at least one dimension of the fracture; and further pumping fracturing fluid, within the fracturing job time period, into the well in response to the generated signals. Further pumping includes controlling at least one of a pump rate of the further pumping and a viscosity (either fluid viscosity or particulate concentration) of the further pumped fracturing fluid. Control can include comparing a measured magnitude of at least one dimension of the fracture represented by the generated signals with a predetermined modeled magnitude of the same dimension. Tiltmeters can be used to sense fracture height and width, for example.

7 Claims, 2 Drawing Sheets

U.S. PATENT DOCUMENTS

| | | | | | |
|---|---|---|---|---|---|
| 5,771,170 | A | | 6/1998 | Withers et al. | 364/421 |
| 5,934,373 | A | * | 8/1999 | Warpinski et al. | 166/250.1 |
| 5,944,446 | A | | 8/1999 | Hocking | 405/128 |
| 5,963,508 | A | | 10/1999 | Withers | 367/38 |
| 5,996,726 | A | | 12/1999 | Sorrells et al. | 181/106 |
| 6,002,063 | A | * | 12/1999 | Bilak et al. | 588/17 |
| 6,049,508 | A | | 4/2000 | Deflandre | 367/48 |
| 6,216,783 | B1 | | 4/2001 | Hocking et al. | 166/250.1 |
| 6,330,914 | B1 | | 12/2001 | Hocking et al. | 166/250.1 |
| 6,370,784 | B1 | * | 4/2002 | Hunter et al. | 33/395 |
| 6,389,361 | B1 | | 5/2002 | Geiser | 702/15 |
| 2003/0205375 | A1 | * | 11/2003 | Wright et al. | 166/250.1 |

OTHER PUBLICATIONS

R. G. Keck, W. L. Nehmer, and G. S. Strumolo, "A New Method for Predicting Friction Pressure and Rheology of Proppant–Laden Fracturing Fluids," SPE 19771, Society of Petroleum Engineers, Inc., pp. 659–670 (1989).

Internet Web page article entitled "PowerSTIM Brochure," Schlumberger Limited, published at www.slb.com, © 2000 (3 pp.).

Internet Web page article entitled "2001 Press Releases," Halliburton, published at www.halliburton.com, © 2002, article entitled "Halliburton and Pinnacle Technologies Announce New FRACTRAC$^{SM}$ TW Service for Direct, Real–Time Measurement of Fracture Geometry" (for release Oct. 2, 2001) (3 pp.).

Article entitled "The Distribution of Stress in the Neighborhood of a Flat Elliptical Crack in an Elastic Solid," Proc. Camb. Phil. Soc., 46, 159–163.

* cited by examiner

MITIGATING RISK BY USING FRACTURE MAPPING TO ALTER FORMATION FRACTURING PROCESS

BACKGROUND OF THE INVENTION

This invention relates generally to methods for fracturing a formation communicating with a well, such as a hydrocarbon-bearing formation intersected by an oil or gas production well.

There are various uses for fractures created in subterranean formations. In the oil and gas industry, for example, fractures may be formed in a hydrocarbon-bearing formation to facilitate recovery of oil or gas through a well communicating with the formation.

Fractures can be formed by pumping a fracturing fluid into a well and against a selected surface of a formation intersected by the well. Pumping occurs such that a sufficient hydraulic pressure is applied against the formation to break or separate the earthen material to initiate a fracture in the formation.

A fracture typically has a narrow opening that extends laterally from the well. To prevent such opening from closing too much when the fracturing fluid pressure is relieved, the fracturing fluid typically carries a granular or particulate material, referred to as "proppant," into the opening of the fracture. This proppant remains in the fracture after the fracturing process is finished. Ideally, the proppant in the fracture holds the separated earthen walls of the formation apart to keep the fracture open and provides flow paths through which hydrocarbons from the formation can flow at increased rates relative to flow rates through the unfractured formation.

Such a fracturing process is intended to stimulate (that is, enhance) hydrocarbon production from the fractured formation. Unfortunately, this does not always happen because the fracturing process can damage rather than help the formation.

One type of such damage is referred to as a screen-out or sand-out condition. In this condition, the proppant clogs the fracture such that hydrocarbon flow from the formation is diminished rather than enhanced. As another example, fracturing can occur in an undesired manner, such as with a fracture extending vertically into an adjacent water-filled zone. Because of this, there is a need for a method for fracturing a formation that provides for real-time control of the fracturing process.

SUMMARY OF THE INVENTION

The present invention meets the aforementioned need by providing a method for fracturing a formation in a manner to mitigate risk to hydrocarbon productivity arising from the fracturing. This method comprises: pumping fracturing fluid, during at least part of a fracturing job time period, into a well to initiate or extend a fracture in a formation with which the well communicates; generating signals, within the fracturing job time period, in response to at least one dimension of the fracture; and further pumping fracturing fluid, within the fracturing job time period, into the well in response to the generated signals, including controlling in response to the generated signals at least one of a pump rate of the further pumping and a viscosity of the further pumped fracturing fluid.

Generating signals preferably includes sensing height or width, or both, of the fracture. This can be accomplished by using, for example, tiltmeters disposed in the well.

Viscosity can be controlled by changing the viscosity of a fluid phase of the fracturing fluid; it can also or alternatively be controlled by changing the concentration of a particulate phase in the fracturing fluid.

Controlling in response to the generated signals can include comparing a measured magnitude of a respective dimension of the fracture represented by the generated signals with a predetermined modeled magnitude of the same dimension.

Other and further objects, features and advantages of the present invention will be readily apparent to those skilled in the art when the following description of the preferred embodiments is read in conjunction with the accompanying drawings.

DETAILED DESCRIPTION OF THE INVENTION

Figure 1:
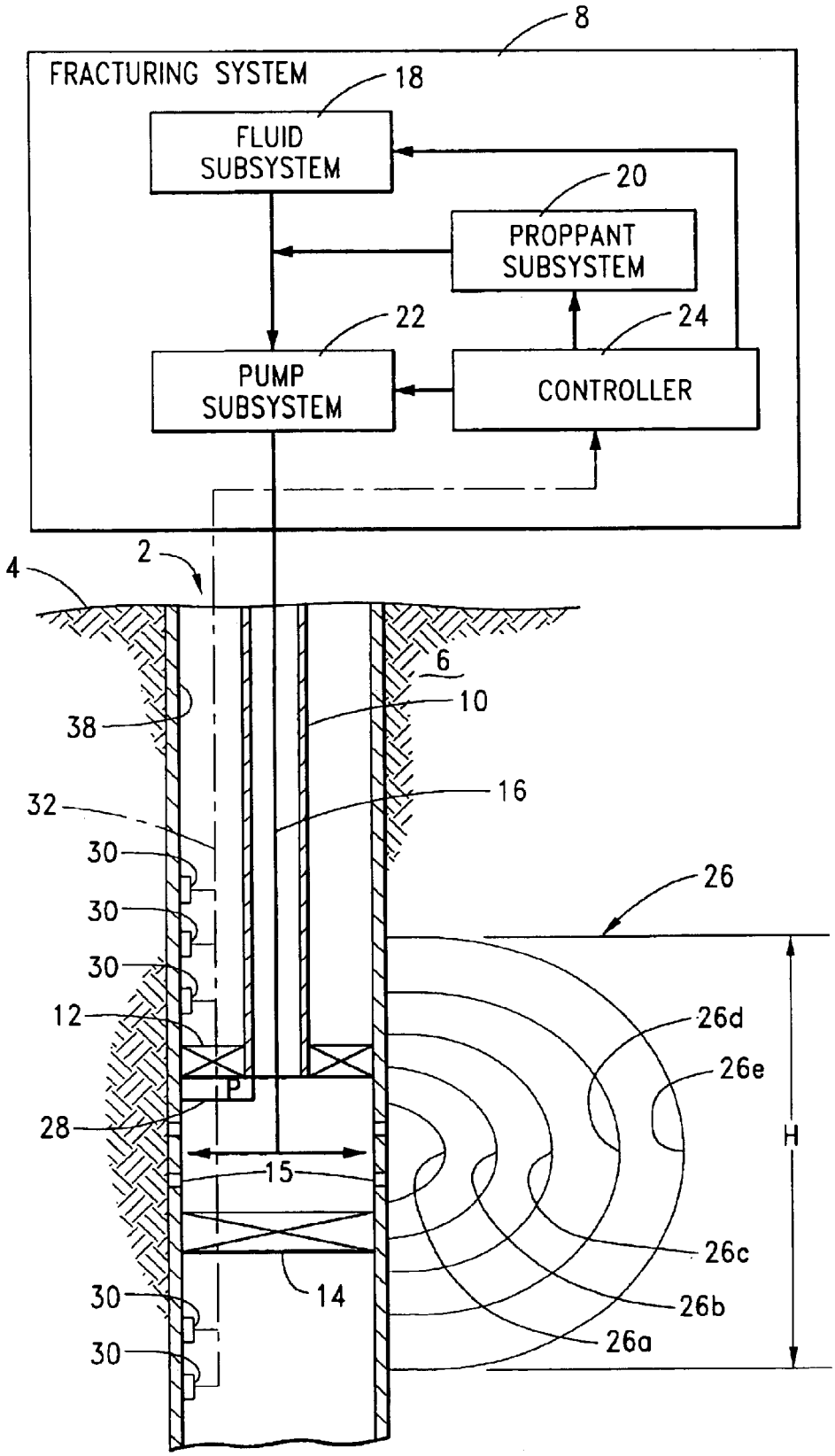
FIG. 1 is a schematic and block diagram of a well undergoing a fracturing treatment in accordance the present invention.

Referring to FIG. 1, a cased or uncased well 2 formed in the earth 4 (whether terrestrial or subsea) in a suitable manner known in the art communicates with a subterranean formation 6. Specifically in FIG. 1, the well 2 intersects the formation 6 such that at least part of the well bore is defined by part of the formation 6. A fracturing fluid from a fracturing system 8 can be applied against such part of the formation 6 to fracture it. In one typical manner of doing so, a fluid-conductive pipe or tubing string 10 is suitably disposed in the well 2; and pack-off assembly 12 and bottom hole packer 14, or other suitable means, are disposed to select and isolate the particular surface of the formation 6 against which the fracturing fluid is to be applied through one or more openings in the pipe or tubing string 10 or casing or cement if such otherwise impede flow into the selected portion of the formation 6 (for example, through perforations 15 formed by a perforating process as known in the art). This surface can include the entire height of the formation 6 or a portion or zone of it.

The fracturing system 8 communicates with the pipe or tubing string 10 in known manner so that a fracturing fluid can be pumped down the pipe or tubing string 10 and against the selected portion of the formation 6 as represented by flow-indicating line 16 in FIG. 1. The fracturing system 8 includes a fluid subsystem 18, a proppant subsystem 20, a pump subsystem 22, and a controller 24.

Fluid subsystem 18 of a conventional type typically includes a blender and sources of known substances that are added in known manner into the blender under operation of the controller 24 or control within the fluid subsystem 18 to obtain a liquid or gelled fracturing fluid base having desired fluid properties (for example, viscosity, fluid quality).

Proppant subsystem 20 of a conventional type includes proppant in one or more proppant storage devices, transfer apparatus to convey proppant from the storage device(s) to the fracturing fluid from the fluid subsystem 18, and proportional control apparatus responsive to the controller 24 to drive the transfer apparatus at a desired rate that will add a desired quantity of proppant to the fluid to obtain a desired proppant/particulate concentration in the fracturing fluid.

Pump subsystem 22 of a conventional type includes a series of positive displacement pumps that receive the base fluid/proppant mixture or slurry and inject the same into the wellhead of the well 2 as the fracturing fluid under pressure. Operation of the pumps of the pump subsystem 22 in FIG. 1, including pump rate, is controlled by the controller 24.

Controller 24 includes hardware and software (for example, a programmed personal computer) that allow practitioners of the art to control the fluid, proppant and pump subsystems 18, 20, 22. Data from the fracturing process, including real-time data from the well and the aforementioned subsystems, is received and processed by the controller 24 to provide monitoring and other informational displays to the practitioner/operator and to provide control signals to the subsystems, either manually (such as via input from the operator) or automatically (such as via programming in the controller 24 that automatically operates in response to the real-time data). The hardware can be conventional as can the software except to the extent the hardware or software is adapted to implement the processing described herein with regard to the present invention. Particular adaptation(s) can be made by one skilled in the art given the disclosure set forth in this specification.

Also represented in FIG. 1 is a pressure sensor 28 (one is illustrated, but a plurality can be used). The bottom hole pressure can be measured either directly by the pressure sensor 28 or through a process of determining it from reading surface treating data. The relationship of bottom hole pressure to surface pressure is well known in the art, as reflected by the following equation: BHTP=STP+Hydrostatic Head−ΔP Friction, where: BHTP=bottom hole treating pressure; STP=surface treating pressure; Hydrostatic Head=pressure of the slurry/fluid column; and ΔP Friction=all pressure drops along the flow path due to friction. Because ΔP Friction can be difficult to determine for various fracturing fluids, for example, it is preferable to measure bottom hole pressure directly, such as with a pressure gauge run in the string (for example, in the bottom hole assembly) so that computing the effects of friction pressures is obviated. Pressure sensor 28 represents such a downhole pressure gauge.

Figure 2:
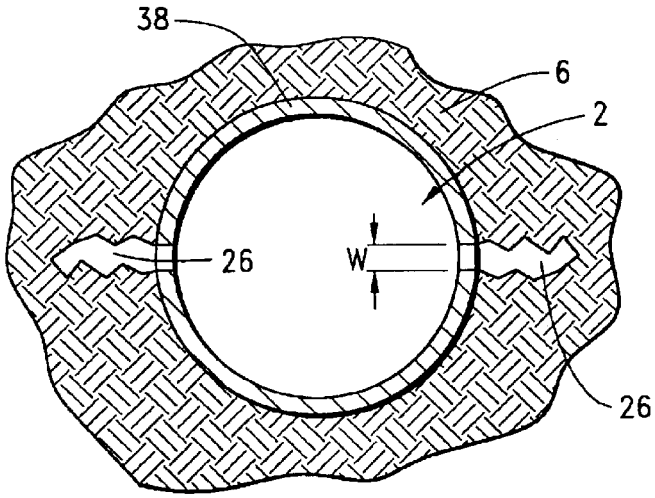
FIG. 2 is a sectional view of the borehole and casing of the well of FIG. 1, in which view both wings of a fracture and a width dimension thereof are represented.

Such components as mentioned above may be conventional equipment assembled and operated in known manner except as modified in accordance with the present invention as further explained below. In general, however, such equipment is operated to pump a viscous fracturing fluid, containing proppant during at least part of the fracturing process, down the pipe or tubing string 10 and against the selected portion of the formation 6. When sufficient pressure is applied, the fracturing fluid initiates or extends a fracture 26 that typically forms in opposite directions from the bore of the well 2 as shown in FIG. 2 (only one direction or wing of which is illustrated in FIG. 1). Extension of fracture 26 over time is indicated in FIG. 1 by successive fracture edges 26*a*–26*e* progressing radially outwardly from the well 2.

Thus, as part of the present invention, fracturing fluid is pumped, during at least part of a fracturing job time period, into the well 2 to initiate or extend the fracture 26 in the formation 6 with which the well 2 communicates. At least within the fracturing job time period, whether or not pumping is simultaneously occurring, signals are generated in response to at least one dimension of the fracture 26. Preferably one or both of fracture height and fracture width (also referred to as hydraulic height and hydraulic width) are detected. Fracture height is typically the dimension in the direction marked with an "H" in FIG. 1, and fracture width is the dimension perpendicular to such height dimension and into or out of the sheet of FIG. 1 (that is, the dimension in the direction of a tangent of an arc of the circumference of the well; as opposed to length or depth, which is the dimension measured in a radially outward direction from the well 2; see FIG. 2 for an illustration of a width "W"). Signals are generated in response to the detected dimension or dimensions, and such signals are sent to the controller 24 by any suitable signal transmission technique (for example, electric, acoustic, pressure, electromagnetic). This preferably is performed in real time as further pumping of fracturing fluid occurs, or at least during the fracturing job time period even if pumping is not occurring (that is, during an overall fracturing job, there may be times when pumping is stopped, but preferably data gathering can still occur). Using such fracture mapping in real time, the fracture propagation process can be altered to address risk mitigation. So, one or more real-time detection devices and telemetry systems are preferably used to gather and send information about fracture geometry in real time and provide control signals to the controller 24 in response to such detected geometry. In FIG. 1 this is illustrated to be accomplished using a plurality of tiltmeters 30 (five are illustrated, but any suitable number can be used) from which real-time data is communicated to the controller 24 via any suitable telemetry means 32 (for example, electric, acoustic, pressure, electromagnetic, as mentioned above).

Fracturing in accordance with the foregoing causes the surrounding rock of the formation 6 to move or deform slightly, but enough to allow the array of ultra-sensitive tiltmeters 30 to detect the slight tilting. The tilting, or deformation, pattern observed at the earth's surface reveals the primary direction of the cracking that can be up to several thousand feet below, which helps drillers decide where to sink additional wells. By placing tiltmeters downhole in offset wellbores, fracture dimensions (height, length and width) can also be measured. Fracture dimensions are important in determining the area of the pay that is in contact with the hydraulically created fracture. For instance, if the fracture height is twenty-five percent less than anticipated, a well may only produce up to seventy-five percent of its potential recovery. If a fracture is much taller than anticipated, then the length of the fracture will likely be shorter than desired and ultimate recovery may suffer as a result. By being able to measure these dimensions directly, well operators can determine whether they are achieving desired hydraulic fracture dimensions.

Figure 3:
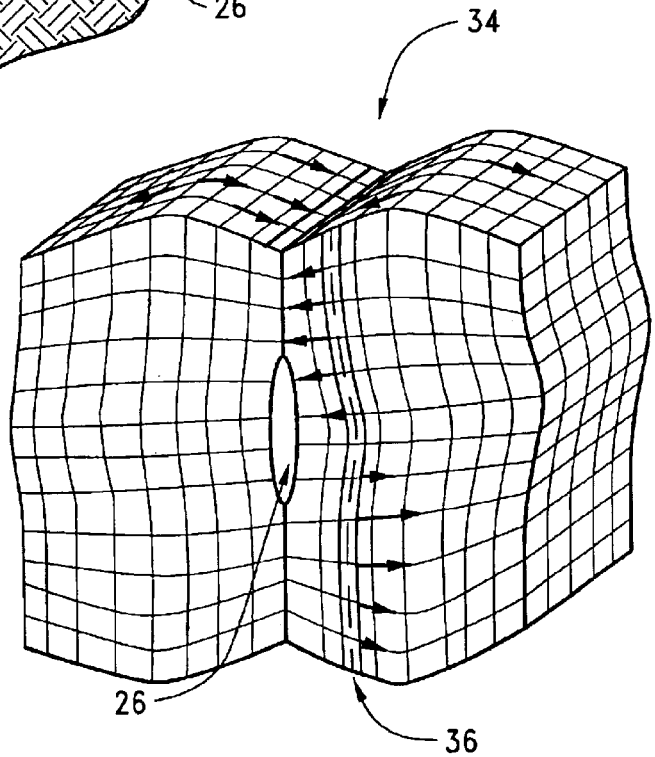
FIG. 3 is a graphical representation illustrating tiltmeter responses to a subterranean fracture.

FIG. 3 represents how tiltmeters, such as tiltmeters 30, can respond in order to measure the orientation or direction of a hydraulically induced vertical fracture (such as fracture 26, for example). An array of tiltmeters placed at the surface can sense the deformation pattern of a resultant trough 34 that is in the same direction (orientation) as the fracture 26, which may be a mile or more beneath the surface of the earth, for example. Additionally, the deformation pattern as measured by tiltmeters placed downhole (in an offset wellbore, or in the treatment wellbore itself such as where tiltmeters 30 are) can be used to measure fracture height, width and sometimes length. Such a response is illustrated in the portion of the representation marked by the reference numeral 36 in FIG. 3.

Tiltmeters of one known type used for tiltmeters 30 have a liquid electrolyte filled glass tube containing a gas bubble.

Such tiltmeter sensor has electrodes in it so that the circuitry can detect the position (or tilt) of the bubble. There is a "common" or excitation electrode, and an "output" or "pick-up" electrode on either end. A time varying signal is applied to the common electrode and each output electrode is connected through a resistor to ground. This provides a resistive bridge circuit, with the other two "resistors" being variable as defined by the respective resistances of the electrolyte portions between the common electrode and each of the two output electrodes. The signals at the two output electrodes go to inputs of a differential amplifier, whose output is rectified and further amplified. This amplified analog signal is low pass filtered and digitized by an analog-to-digital converter. In one particular implementation, the data signals from the analog-to-digital converter are communicated to the surface in real-time through a commonly available single conductor electric wireline into a recording unit for display and processing (specifically the controller 24 in the illustration of FIG. 1); however, other suitable signal communication techniques can be used.

A respective pair of these sensors placed orthogonal to one another is used in each tiltmeter 30 and an array of three to twenty, for example, of these tiltmeters 30 is placed across the interval to be fractured such as illustrated in FIG. 1 or 3 (preferably above and below the isolated region within the well where the fracturing fluid is applied against the formation, which region is between packers 12, 14 in FIG. 1, and also preferably to cover the range of fracture height growth). In a particular implementation, the tiltmeters 30 are mounted to casing 38 (disposed in known manner in the well 2) by permanent magnets, and the casing 38 in turn is coupled to the formation by an external cement sheath (not separately shown in the drawings, but as known in the art) so the casing 38 will bend or deform in the same manner as the formation 6 due to the presence of the hydraulic fracture 26. The tiltmeters 30 are preferably securely coupled to the casing 38 out of the most turbulent part of any adjacent fluid flow stream (the ones shown in FIG. 1 are outside the intended path of flow 16). In an uncased well, some coupling between the tiltmeters and the borehole wall is needed (for example, a mechanical coupling such as might be provided by bowspring centralizers or decentralizers).

Once data is obtained from the tiltmeters 30, it can be converted in the controller 24 into information about one or more dimensions of the fracture 26. At least either or both fracture width and fracture height can be determined as known in the art. Fracture width can be determined, for example, by integrating the induced tilt from a point largely unaffected by the fracture (above or below a vertical fracture, a point along the length of a fracture but beyond its extent, or an analogous point for a non-vertical fracture) to a point in the center of the fracture. The integration of tilt along a length provides a total deformation along that length. If the signals are taken immediately adjacent to the fracture, the total deformation will be equal to half the fracture width. If there is a medium between the fracture and the signals, the deformation pattern is modified by the medium. The modification can be reliably estimated through the use of a common model, such as that provided by Green and Sneddon (1950) ("The Distribution of Stress in the Neighborhood of a Flat Elliptical Crack in an Elastic Solid," Proc. Camb. Phil. Soc., 46, 159–163).

Fracture height can be determined, for example, by observing the induced tilt from a point largely unaffected by the fracture to a point significantly affected by the fracture growth. If the signals, are taken immediately adjacent to the fracture, a large peak in tilt will occur at the edges of the fracture. Tracking of these peak(s) over time provides a measurement of the growth of the edges of the fracture. If there is a medium between the fracture and the signals, the deformation pattern is modified by the medium. The modification can be reliably estimated through the use of a common model, such as that provided by Green and Sneddon (1950) ("The Distribution of Stress in the Neighborhood of a Flat Elliptical Crack in an Elastic Solid," Proc. Camb. Phil. Soc., 46, 159–163).

The foregoing conversion(s) from tiltmeter data signal to measured fracture dimension can be implemented by suitably programming the controller 24 as readily known in the art given the explanation of the invention herein. For example, conversion tables or mathematical equation computations can be implemented using the controller 24.

To mitigate risk to hydrocarbon productivity arising from the overall fracturing process, such as to avoid screen-outs or sand-outs or unintended fracture growth, further pumping of fracturing fluid into the well 2 is controlled in response to the generated signals from the sensors. This includes controlling in response to the generated signals from the tiltmeters 30 for the FIG. 1 example at least one of a pump rate of the further pumping and a viscosity of the further pumped fracturing fluid. When viscosity is controlled, it can be by either or both of changing the viscosity of the fluid phase (for example, the base gel) of the fracturing fluid or changing the concentration of the particulate phase (for example, the proppant) in the fracturing fluid. Such changes can be made by the controller 24 or the operator controlling one or more of the speed of the pumps in the pump subsystem 22, the flows of materials into the blender of the fluid subsystem 18, and the transfer rate of proppant from the proppant subsystem 20.

For purposes of simplifying the further explanation, reference will be made to width as having been determined from the signals of the tiltmeters 30. Knowing width, this can be compared to a model created for the respective well. Such model is made in conventional manner during the fluid design phase when one skilled in the art designs the fracturing fluid to be used for the particular well undergoing treatment. Although the specific relationship between fracture width and time or volume of fluid pumped may vary from well to well, the general relationship is shown by curve or graph line 40 in FIG. 4. If the actual width determined from the tiltmeter signals and the aforementioned modeled relationship is outside a preselected tolerable variance 42 of the modeled width curve 40 (such as determined using the controller 24 and/or human observation therefrom), corrective action can be taken. The variance 42 can be zero; or it can be both greater than and less (by the same or different amounts) than the desired relationship represented by graph line 40; or it can be only greater or only less than the desired magnitude (that is, some permitted variance in one direction but zero tolerance in the other direction relative to the graph line 40). If some variance is selected for both greater than and less than the desired fracture width growth represented by the relationship of graph line 40 (such a variance being indicated by reference numeral 42), a measured width plotted at point 44 would not prompt corrective control action because this measured width is within the permissible range. A too-large measured width represented by point 46 in FIG. 4, or a too-small measured width represented by point 48 in FIG. 4, would prompt corrective action. Thus, in this illustration controlling in response to the generated signals includes comparing a measured magnitude of at least one dimension of the fracture represented by the generated signals with a predetermined modeled magnitude of the same at least one dimension.

Following are illustrative but not limiting examples of detected problems and corrective actions.

In the event that the measured width is increasing at a rate rapidly faster than the model indicates that it should (for example, as indicated at measured data point 46 in FIG. 4), and a rapid increase in bottom hole treating pressure occurs simultaneously as detected by the pressure sensor 28, for example, and suitably telemetered to the controller 24, one skilled in the art (or the controller 24 if suitably programmed) would know that a bridge in the fracture, possibly caused by proppant hitting an obstruction, has occurred. One or more of the following corrective steps might then be taken: increase injection rate, increase fluid viscosity, alter proppant concentration. These options arise because hydraulic width is a function of injection (slurry flow) rate, fracture length, viscosity of the fracturing fluid and Young's Modulus of the formation rock at the point of injection. A form of modeling width is the equation:

$$\text{Width}=0.15[(\text{slurry flow rate})(\text{slurry viscosity})(\text{fracture length})/\text{Young's Modulus}]^{0.25}$$

This is known as the Perkins and Kern width equation. There are other equations, such as from Geertsma and DeKlerk, which also relate hydraulic width with injection rate, viscosity of the fracturing fluid and fracture geometry.

If corrective action is to be taken, the operator may choose to control either or both of flow rate or viscosity as indicated by the above relationship. Slurry flow rate is controllable via the pump speed of the pumps of the pump subsystem 22. The viscosity factor is controllable through either or both of the fluid viscosity or the proppant concentration in the slurry as explained below. Rate is the first factor to use for corrective action if speed of correction is desired because a change in flow rate of the fracturing fluid or slurry, as effected by the controller 24 or the operator controlling the pumps of the pump subsystem 22, has an immediate effect downhole. Viscosity changes, on the other hand, do not have an effect downhole until after displacing the existing volume of slurry between the downhole location and the surface point at which the viscosity change appears.

Regarding fluid viscosity change (that is, a change in the viscosity of the base gel or other liquid phase of the fracturing fluid or slurry), this is more quickly effective in on-the-fly fluid blending configurations than in batch blending configurations because there is no large volume of pre-mixed fluid to be used up or reblended in an on-the-fly configuration.

The viscosity factor of the aforementioned width equation can also be affected by changing the amount of the particulate phase in the fracturing fluid, whereby the concentration of particulate (for example, the proppant) in the fluid is changed. For a Newtonian fluid, particulate and viscosity are related as described in "Effects of particle properties on the rheology of concentrated non-colloidal suspensions," Tsai, Botts and Plouff, *J. Rheol.* 36(7) (October 1992), incorporated herein by reference, which discloses the following relationship:

$$\text{Viscosity (relative)}=[1-(\text{particle volume fraction}/\text{maximum particle packing fraction})]^{-X}$$ where X=intrinsic relative viscosity of the suspension x maximum particle packing fraction).

For non-Newtonian fluids, "A New Method for Predicting Friction Pressure and Rheology of Proppant-Laden Fracturing Fluids", Keck, Nehmer and Strumlo, Society of Petroleum Engineers (SPE) paper no. 19771 (1989), incorporated herein by reference, discloses the following relationship between viscosity and particulate component:

$$\text{Viscosity (relative)}=\{1+[0.75(e^{1.5n'}-1)\,(e^{-(1-n')(shear)/1000})][1.25\phi/(1-1.5\phi)]\}^2$$ where: n'=unitless power-law flow index for unladen fluid, $\phi$=particle volume fraction of the slurry, and shear=unladen Newtonian shear rate.

Figure 4:
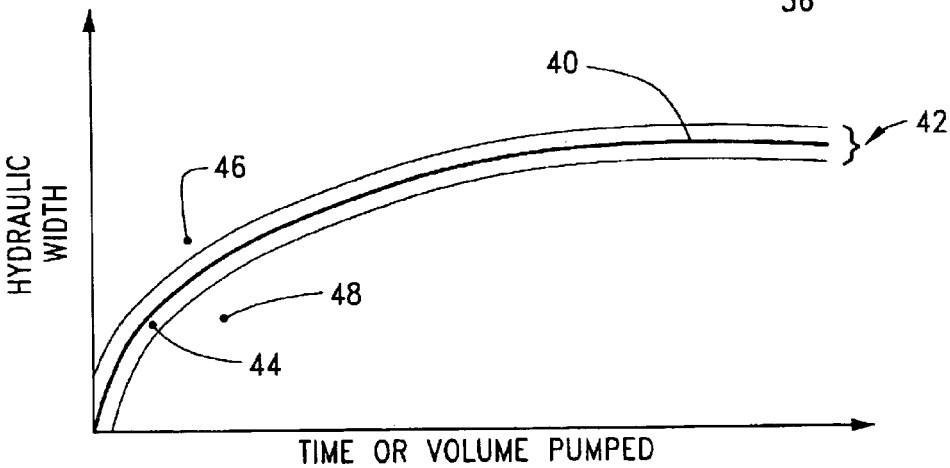
FIG. 4 is a graphical representation of a relationship between hydraulic (fracture) width and time or volume of fracturing fluid pumped.

Another example of responsiveness to the downhole information is when the actual width detected by the tiltmeters 30 indicates that the width is significantly smaller than what was modeled for the time or volume pumped point in the fracturing process (such as indicated at measured data point 48 in FIG. 4). Too small of a width can indicate uncontrolled fracture height growth. In such case, the pressurized fracturing fluid is causing the formation to rapidly split vertically with little width growth. This can create a damaging situation if an undesirable vertically adjacent formation or zone, such as one containing water, were to be communicated through the too-high fracture with the pay zone that is intended to be fractured. If this were the developing situation indicated by the real-time tiltmeter data, the operator (or suitably programmed controller 24) could respond by immediately stopping the pumping in the pump subsystem 22 and thus reduce the flow rate factor in the aforementioned width equation to zero.

The aforementioned corrective action control examples can be manually implemented by operator control or by automatic control (for example, by programming controller 24 with responsive signals to control one or more of the subsystems given automatically detected conditions).

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of fracturing a formation, the method comprising:

pumping fracturing fluid, during at least part of a fracturing job time period, into a well to initiate or extend a fracture in a formation with which the well communicates;

using tiltmeters to sense at least one dimension of the fracture;

generating signals in response to the at least one dimension of the fracture, within the fracturing job time period; and further pumping fracturing fluid, within the fracturing job time period, into the well in response to the generated signals, including controlling in response to the generated signals at least one of a pump rate of the further pumping and a viscosity of the further pumped fracturing fluid, wherein controlling in response to the generated signals includes comparing a measured magnitude of the at least one dimension of the fracture represented by the generated signals with a predetermined modeled magnitude of the same at least one dimension, the method including detecting a bridge in the fracture, wherein:

detecting the bridge in the fracture includes measuring a treating pressure;

using tiltmeters includes sensing a width of the fracture; and comparing the measured magnitude of the at least one dimension of the fracture represented by the generated signals with the predetermined modeled magnitude of the same at least one dimension includes comparing the width sensed by the tiltmeters with a predetermined width.

2. The method of claim 1, wherein detecting the bridge includes:

determining that the width sensed by the tiltmeters is increasing faster than the predetermined width adjusted by a variance.

3. The method of claim 1, wherein controlling the pump rate includes altering the pump rate responsive to detecting the bridge in the fracture.

4. The method of claim 1, wherein controlling the viscosity of the further pumped fracturing fluid includes altering the viscosity of the further pumped fracturing fluid responsive to detecting the bridge in the fracture.

5. A method of fracturing a formation, the method comprising:

pumping fracturing fluid, during at least part of a fracturing job time period, into a well to initiate or extend a fracture in a formation with which the well communicates;

using tiltmeters to sense at least one dimension of the fracture;

generating signals in response to the at least one dimension of the fracture, within the fracturing job time period; and further pumping fracturing fluid, within the fracturing job time period, into the well in response to the generated signals, including controlling in response to the generated signals at least one of a pump rate of the further pumping and a viscosity of the further pumped fracturing fluid, wherein controlling in response to the generated signals includes comparing a measured magnitude of the at least one dimension of the fracture represented by the generated signals with a predetermined modeled magnitude of the same at least one dimension, the method including detecting a bridge in the fracture, wherein controlling the viscosity of the further pumped fracturing fluid includes altering the viscosity of the further pumped fracturing fluid responsive to detecting the bridge in the fracture, wherein:

using tiltmeters includes sensing a width of the fracture; and comparing the measured magnitude of the at least one dimension of the fracture represented by the generated signals with the predetermined modeled magnitude of the same at least one dimension includes comparing the width sensed by the tiltmeters with a predetermined width.

6. The method of claim 5, the method including:

determining that the width sensed by the tiltmeters is increasing slower than the predetermined width adjusted by a variance.

7. The method of claim 5, wherein controlling the pump rate includes stopping pumping responsive to detecting uncontrolled fracture height growth.

* * * * *